US008995604B2

(12) United States Patent
Singh et al.

(10) Patent No.: US 8,995,604 B2
(45) Date of Patent: Mar. 31, 2015

(54) SYSTEM, METHOD AND APPARATUS FOR PROVIDING ADDITIONAL RADIATION SHIELDING TO HIGH LEVEL RADIOACTIVE MATERIALS

(75) Inventors: Krishna P. Singh, Jupiter, FL (US); Stephen J. Agace, Marlton, NJ (US); Paul Stefan Anton, Wynnewood, PA (US)

(73) Assignee: Holtec International, Inc.

( * ) Notice: Subject to any disclaimer, the term of this patent is extended or adjusted under 35 U.S.C. 154(b) by 680 days.

(21) Appl. No.: 12/940,804

(22) Filed: Nov. 5, 2010

(65) Prior Publication Data

US 2011/0172484 A1 Jul. 14, 2011

Related U.S. Application Data

(60) Provisional application No. 61/258,240, filed on Nov. 5, 2009.

(51) Int. Cl.

| | |
|---|---|
| ***G21C 19/00*** | (2006.01) |
| ***G21F 5/10*** | (2006.01) |
| ***G21F 5/06*** | (2006.01) |

(52) U.S. Cl.

CPC ... *G21F 5/10* (2013.01); *G21F 5/06* (2013.01)

USPC ..... 376/272

(58) Field of Classification Search

CPC ..... G21F 5/06; G21F 5/10

USPC ..... 376/272

See application file for complete search history.

(56) References Cited

U.S. PATENT DOCUMENTS

| | | | |
|---|---|---|---|
| 3,229,096 | A | 1/1966 | Bonilla et al. |
| 3,414,727 | A | 12/1968 | Bonilla |

(Continued)

FOREIGN PATENT DOCUMENTS

| | | | |
|---|---|---|---|
| DE | 3801550 | * | 7/1989 |
| EP | 314025 | | 5/1989 |

(Continued)

OTHER PUBLICATIONS

International Atomic Energy Agency (IAEA), "Multi-Purpose Container Technologies for Spent Fuel Management," IAEA-TECDOC-1192, Dec. 2000.

*Primary Examiner* — Frank J McGue

(74) *Attorney, Agent, or Firm* — The Belles Group, PC

(57) ABSTRACT

A system, method and apparatus for providing additional radiation shielding to a ventilated cask for holding high level radioactive materials. The invention utilizes a tubular shell that is ancillary to the ventilated cask that circumscribes the ventilated cask to add radiation shielding protection while improving heat removal by natural convective air flow. Because the tubular shell and cask are non-unitary and slidably separable from one another, crane lifting capacity is not affected. In one aspect, the invention is an apparatus for providing additional radiation shielding to a cask holding high level radioactive materials comprising: a tubular shell extending from an open bottom end to an open top end, the tubular shell having an inner surface that forms a cavity about a longitudinal axis; a plurality of primary apertures forming passageways through the tubular shell and circumferentially arranged in a spaced-apart manner about the tubular shell; a plurality of secondary apertures forming passageways through the tubular shell and circumferentially arranged in a spaced-apart manner about the tubular shell; and an annular seal coupled to the tubular shell and extending from the inner surface of the tubular shell; wherein the secondary apertures are located at an axial height above the annular seal and the primary apertures are located at an axial height below the annular seal.

42 Claims, 7 Drawing Sheets

(56) References Cited

U.S. PATENT DOCUMENTS

| | | | | | |
|---|---|---|---|---|---|
| 3,536,134 | A | | 10/1970 | Staub | |
| 3,669,299 | A | | 6/1972 | Jones et al. | |
| 3,765,549 | A | | 10/1973 | Jones | |
| 3,780,306 | A | | 12/1973 | Anderson et al. | |
| 3,845,315 | A | | 10/1974 | Blum | |
| 3,877,515 | A | | 4/1975 | Laing | |
| 3,886,368 | A | | 5/1975 | Rollins et al. | |
| 3,910,006 | A | | 10/1975 | James | |
| 3,917,953 | A | | 11/1975 | Wodrich | |
| 3,962,587 | A | | 6/1976 | Dufrane et al. | |
| 3,982,134 | A | | 9/1976 | Housholder et al. | |
| 4,069,923 | A | | 1/1978 | Blumenau et al. | |
| 4,099,554 | A | * | 7/1978 | Haese | 165/299 |
| 4,147,938 | A | | 4/1979 | Heckman et al. | |
| 4,197,467 | A | | 4/1980 | Williams | |
| 4,288,698 | A | | 9/1981 | Baatz et al. | |
| 4,336,460 | A | | 6/1982 | Best et al. | |
| 4,366,095 | A | | 12/1982 | Takats | |
| 4,450,134 | A | | 5/1984 | Soot et al. | |
| 4,498,011 | A | | 2/1985 | Dyck et al. | |
| 4,527,066 | A | | 7/1985 | Dyck et al. | |
| 4,532,104 | A | | 7/1985 | Wearden et al. | |
| 4,535,250 | A | | 8/1985 | Fields | |
| 4,634,875 | A | | 1/1987 | Kugeler et al. | |
| 4,636,645 | A | | 1/1987 | Kessinger | |
| 4,666,659 | A | * | 5/1987 | Lusk et al. | 376/272 |
| 4,672,213 | A | | 6/1987 | Stoll et al. | |
| 4,711,758 | A | * | 12/1987 | Machado et al. | 376/272 |
| 4,738,388 | A | | 4/1988 | Bienek et al. | |
| 4,749,520 | A | * | 6/1988 | Meininger et al. | 588/3 |
| 4,770,844 | A | | 9/1988 | Davis, Jr. | |
| 4,780,268 | A | | 10/1988 | Papai et al. | |
| 4,780,269 | A | | 10/1988 | Fischer et al. | |
| 4,800,062 | A | | 1/1989 | Craig et al. | |
| 4,800,283 | A | | 1/1989 | Efferding | |
| 4,827,139 | A | * | 5/1989 | Wells et al. | 250/507.1 |
| 4,834,916 | A | | 5/1989 | Chaudon et al. | |
| 4,847,009 | A | | 7/1989 | Madle et al. | |
| 4,914,306 | A | | 4/1990 | Dufrane et al. | |
| 4,926,046 | A | * | 5/1990 | Roy et al. | 250/506.1 |
| 4,935,943 | A | * | 6/1990 | Schweitzer et al. | 376/272 |
| 4,972,087 | A | * | 11/1990 | Neider et al. | 250/507.1 |
| 5,063,299 | A | | 11/1991 | Efferding | |
| 5,102,615 | A | | 4/1992 | Grande et al. | |
| 5,232,657 | A | | 8/1993 | Kovacik et al. | |
| 5,245,641 | A | | 9/1993 | Machado et al. | |
| 5,373,540 | A | | 12/1994 | DeCooman, Sr. et al. | |
| 5,391,887 | A | * | 2/1995 | Murray, Jr. | 250/506.1 |
| 5,406,600 | A | * | 4/1995 | Jones et al. | 376/272 |
| 5,406,601 | A | | 4/1995 | Hinderer et al. | |
| 5,438,597 | A | | 8/1995 | Lehnert et al. | |
| 5,513,232 | A | | 4/1996 | Jones et al. | |
| 5,546,436 | A | | 8/1996 | Jones et al. | |
| 5,564,498 | A | | 10/1996 | Bochard | |
| 5,612,543 | A | | 3/1997 | Wenner et al. | |
| 5,641,970 | A | | 6/1997 | Taniuchi | |
| 5,643,350 | A | | 7/1997 | Mason et al. | |
| 5,646,971 | A | | 7/1997 | Howe | |
| 5,651,038 | A | | 7/1997 | Chechelnitsky | |
| 5,661,768 | A | | 8/1997 | Gilligan et al. | |
| 5,668,843 | A | | 9/1997 | Wasinger | |
| 5,720,789 | A | * | 2/1998 | Pinson | 55/364 |
| 5,848,111 | A | | 12/1998 | Wells et al. | |
| 5,898,747 | A | | 4/1999 | Singh | |
| 5,946,639 | A | | 8/1999 | Hess | |
| 6,064,710 | A | | 5/2000 | Singh | |
| 6,064,711 | A | | 5/2000 | Copson | |
| 6,252,923 | B1 | | 6/2001 | Iacovino et al. | |
| 6,323,501 | B1 | | 11/2001 | White et al. | |
| 6,489,623 | B1 | * | 12/2002 | Peters et al. | 250/506.1 |
| 6,519,307 | B1 | | 2/2003 | Singh et al. | |
| 6,548,029 | B1 | | 4/2003 | Towler et al. | |
| 6,587,536 | B1 | * | 7/2003 | Singh et al. | 376/261 |
| 6,625,246 | B1 | | 9/2003 | Singh et al. | |
| 6,718,000 | B2 | | 4/2004 | Singh et al. | |
| 6,793,450 | B2 | | 9/2004 | Singh et al. | |
| 6,848,223 | B2 | | 2/2005 | Singh et al. | |
| 6,853,697 | B2 | | 2/2005 | Singh et al. | |
| 7,068,748 | B2 | | 6/2006 | Singh et al. | |
| 7,096,600 | B2 | | 8/2006 | Singh et al. | |
| 7,139,358 | B2 | | 11/2006 | Singh et al. | |
| 7,210,247 | B2 | | 5/2007 | Singh et al. | |
| 7,330,525 | B2 | | 2/2008 | Singh et al. | |
| 7,330,526 | B2 | | 2/2008 | Singh et al. | |
| 7,590,213 | B1 | | 9/2009 | Singh et al. | |
| 7,676,016 | B2 | | 3/2010 | Singh et al. | |
| 7,707,741 | B2 | | 5/2010 | Singh et al. | |
| 7,715,517 | B2 | | 5/2010 | Singh et al. | |
| 7,786,456 | B2 | | 8/2010 | Singh et al. | |
| 7,820,870 | B2 | | 10/2010 | Singh et al. | |
| 2003/0076917 | A1 | * | 4/2003 | Georgii | 376/272 |
| 2005/0286674 | A1 | | 12/2005 | Fischer et al. | |
| 2006/0215803 | A1 | * | 9/2006 | Singh | 376/272 |
| 2007/0104305 | A1 | | 5/2007 | Veron | |
| 2009/0069621 | A1 | | 3/2009 | Singh et al. | |
| 2009/0158614 | A1 | | 6/2009 | Singh et al. | |
| 2009/0159550 | A1 | | 6/2009 | Singh et al. | |
| 2009/0175404 | A1 | | 7/2009 | Singh et al. | |
| 2009/0252274 | A1 | | 10/2009 | Singh | |
| 2009/0278063 | A1 | * | 11/2009 | Forster | 250/517.1 |
| 2010/0150297 | A1 | | 6/2010 | Singh | |
| 2010/0212182 | A1 | | 8/2010 | Singh | |
| 2010/0232563 | A1 | | 9/2010 | Singh et al. | |
| 2010/0272225 | A1 | | 10/2010 | Singh | |
| 2010/0284506 | A1 | | 11/2010 | Singh | |
| 2011/0255647 | A1 | * | 10/2011 | Singh | 376/272 |
| 2012/0093274 | A1 | * | 4/2012 | Cantonwine et al. | 376/272 |

FOREIGN PATENT DOCUMENTS

| | | |
|---|---|---|
| GB | 855420 | 11/1960 |
| GB | 2104435 | 3/1983 |
| GB | 2337722 | 1/1999 |

* cited by examiner

SYSTEM, METHOD AND APPARATUS FOR PROVIDING ADDITIONAL RADIATION SHIELDING TO HIGH LEVEL RADIOACTIVE MATERIALS

CROSS-REFERENCE TO RELATED PATENT APPLICATIONS

The present application claims the benefit of U.S. Provisional Application Ser. No. 61/258,240, filed Nov. 5, 2009, the entirety of which is hereby incorporated by reference.

FIELD

The present invention relates generally to the field of containing high level radioactive materials, and specifically to a system, apparatus and method that provides an ancillary for providing additional radiation shielding to a cask containing high level radioactive waste.

BACKGROUND

In the operation of nuclear reactors, the nuclear energy source is in the form of hollow zircaloy tubes filled with enriched uranium, typically referred to as fuel assemblies. When the energy in the fuel assembly has been depleted to a certain level, the assembly is removed from the nuclear reactor. At this time, fuel assemblies, also known as spent nuclear fuel, emit both considerable heat and extremely dangerous neutron and gamma photons (i.e., neutron and gamma radiation). Thus, great caution must be taken when the fuel assemblies are handled, transported, packaged and stored.

After the depleted fuel assemblies are removed from the reactor, they are placed in a canister. Because water is an excellent radiation absorber, the canisters are typically submerged under water in a pool. The pool water also serves to cool the spent fuel assemblies. When fully loaded with spent nuclear fuel, a canister weighs approximately 45 tons. The canisters must then be removed from the pool because it is ideal to store spent nuclear fuel in a dry state. The canister alone, however, is not sufficient to provide adequate gamma or neutron radiation shielding. Therefore, apparatus that provide additional radiation shielding are required during transport, preparation and subsequent dry storage.

The additional shielding is achieved by placing the canisters within large cylindrical containers called casks. Casks are typically designed to shield the environment from the dangerous radiation in two ways. First, shielding of gamma radiation requires large amounts of mass. Gamma rays are best absorbed by materials with a high atomic number and a high density, such as concrete, lead, and steel. The greater the density and thickness of the blocking material, the better the absorption/shielding of the gamma radiation. Second, shielding of neutron radiation requires a large mass of hydrogen-rich material. One such material is water, which can be further combined with boron for a more efficient absorption of neutron radiation.

There are generally two types of casks, transfer casks and storage casks. Transfer casks are used to transport spent nuclear fuel within the nuclear facility. Storage casks are used for the long term dry state storage. Guided by the shielding principles discussed above, storage casks are designed to be large, heavy structures made of steel, lead, concrete and an environmentally suitable hydrogenous material. However, because storage casks are not typically moved, the primary focus in designing a storage cask is to provide adequate radiation shielding for the long-term storage of spent nuclear fuel.

One type of known storage cask is a ventilated vertical module ("VVM"). A VVM is a massive structure made principally from steel and concrete and is used to store a canister loaded with spent nuclear fuel. VVMs stand above ground and are typically cylindrical in shape and extremely heavy, weighing over 150 tons and often having a height greater than 16 feet. VVMs typically have a flat bottom, a cylindrical body having a cavity to receive a canister of spent nuclear fuel, and a removable top lid.

In using a VVM to store spent nuclear fuel, a container loaded with spent nuclear fuel, such as a multi-purpose canister ("MPC"), is placed in the cavity of the cylindrical body of the VVM. Because the spent nuclear fuel is still producing a considerable amount of heat when it is placed in the VVM for storage, it is necessary that this heat energy have a means to escape from the VVM cavity. This heat energy is removed from the outside surface of the MPC by ventilating the VVM cavity. In ventilating the VVM cavity, cool air enters the VVM chamber through bottom ventilation ducts, flows upward past the loaded MPC, and exits the VVM at an elevated temperature through top ventilation ducts. The bottom and top ventilation ducts of existing VVMs are located circumferentially near the bottom and top of the VVM's cylindrical body respectively.

While it is necessary that the VVM cavity be vented so that heat can escape from the MPC, it is also imperative that the VVM provide adequate radiation shielding and that the spent nuclear fuel not be directly exposed to the external environment. The inlet duct located near the bottom of the VVM is a particularly vulnerable source of radiation exposure to security and surveillance personnel who, in order to monitor the loaded VVMs, must place themselves in close vicinity of the ducts for short durations.

Existing VVMs are made of a dual metal shell structure with shielding concrete inside. The density of concrete can be increased in certain applications to the extent necessary to increase the dose attenuation. Increasing the density of concrete is an effective way to reduce dose. Calculations in specific cases show that increasing the density of concrete from 150 lb/cubic feet to 200 lb/cubic feet reduces the accreted dose from a VVM by a factor as high as 10. However, circumstances arise where it is desired to drive down the local area dose rate from one or more VVMs at an Independent Spent Fuel Storage Installation (ISFSI) to a value which is even smaller than that obtainable by using locally available high density concrete. Such a situation may arise, for example, if local or state authorities impose even more stringent dose rate limits than those specified in 10CFR72, or if there is an inhabited space (say, an office building) close to where the loaded casks are arrayed.

SUMMARY

The present invention is directed to an ancillary prismatic shell that can be positioned to circumscribe a vertical ventilated cask loaded with high level radioactive waste to reduce the radiation dose emitted to the environment, and a system incorporating the cask and the apparatus.

In one embodiment, the invention can be a system for containing high level radioactive materials comprising: a cask extending along a longitudinal axis and having an internal cavity for holding high level radioactive materials, the cask comprising at least one inlet vent at a bottom end of the cask for allowing cool air to enter the internal cavity and at least one outlet vent at a top end of the cask for allowing heated air to exit the internal cavity; a tubular shell extending from a bottom end to a top end, the tubular shell positioned to circumferentially surround the cask in a spaced apart manner so that an annular gap exists between the tubular shell and a sidewall of the cask, the tubular shell comprising at least one primary aperture forming a passageway through the tubular shell and at least one secondary aperture forming a passageway through the tubular shell; and an air flow barrier extending between the tubular shell and the sidewall of the cask that separates the annular gap into: (1) a first chamber that forms a passageway between the primary aperture and the inlet vent of the cask; and (2) a second chamber that forms a passageway between the secondary aperture and an opening at the top end of the tubular shell, wherein cross-flow of air between the first and second chambers of the annular gap is prohibited by the air flow barrier.

In another embodiment, the invention can be a system for containing high level radioactive materials comprising: a cask extending along a longitudinal axis and having an internal cavity for holding high level radioactive materials, the cask comprising a plurality of inlet vents at a bottom end of the cask for allowing cool air to enter the internal cavity and a plurality of outlet vents at a top end of the cask for allowing heated air to exit the internal cavity; a tubular shell extending from a bottom end to a top end, the tubular shell positioned to circumferentially surround the cask in a spaced apart manner so that an annular gap exists between the tubular shell and a sidewall of the cask, the tubular shell comprising a plurality of primary apertures forming passageways through the tubular shell and a plurality of secondary apertures forming passageways through the tubular shell; and a flexible annular seal coupled to the tubular shell that separates the annular gap into: (1) an upper chamber that forms a passageway between the primary aperture and the inlet vent of the cask; and (2) a second chamber that forms a passageway between the secondary aperture and an opening at the top end of the tubular shell, wherein cross-flow of air between the first and second chambers of the annular gap is prohibited by the flexible annular seal.

In a further embodiment, the invention can be an apparatus for providing additional radiation shielding to a cask holding high level radioactive materials comprising: a tubular shell extending from an open bottom end to an open top end, the tubular shell having an inner surface that forms a cavity about a longitudinal axis; a plurality of primary apertures forming passageways through the tubular shell and circumferentially arranged in a spaced-apart manner about the tubular shell; a plurality of secondary apertures forming passageways through the tubular shell and circumferentially arranged in a spaced-apart manner about the tubular shell; an annular seal coupled to the tubular shell and extending from the inner surface of the tubular shell; and wherein the secondary apertures are located at an axial height above the annular seal and the primary apertures are located at an axial height below the annular seal.

DETAILED DESCRIPTION

Figure 1:
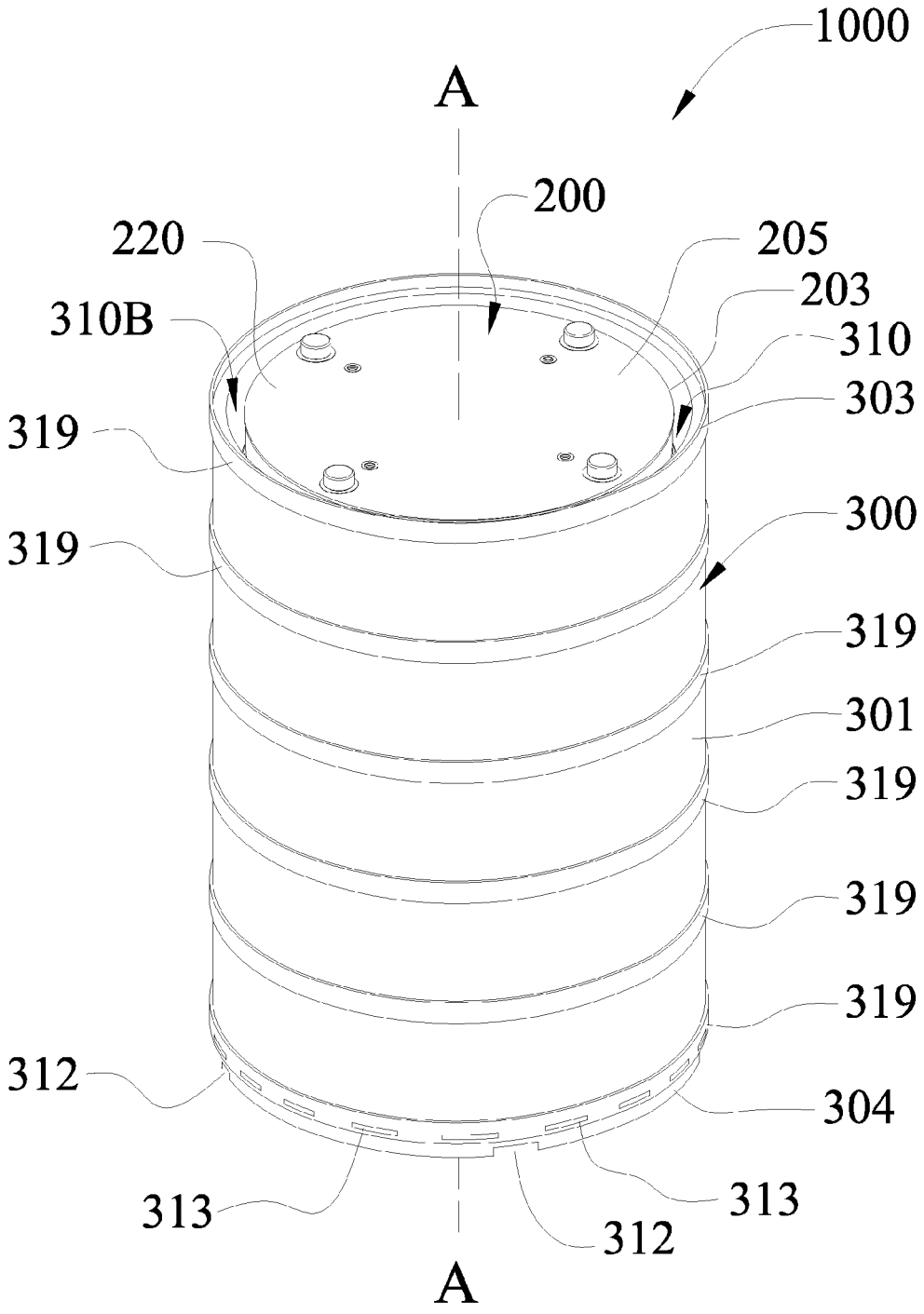
FIG. 1 is a top perspective view of a system for containing high level radioactive waste according to one embodiment of the present invention.
Figure 2:
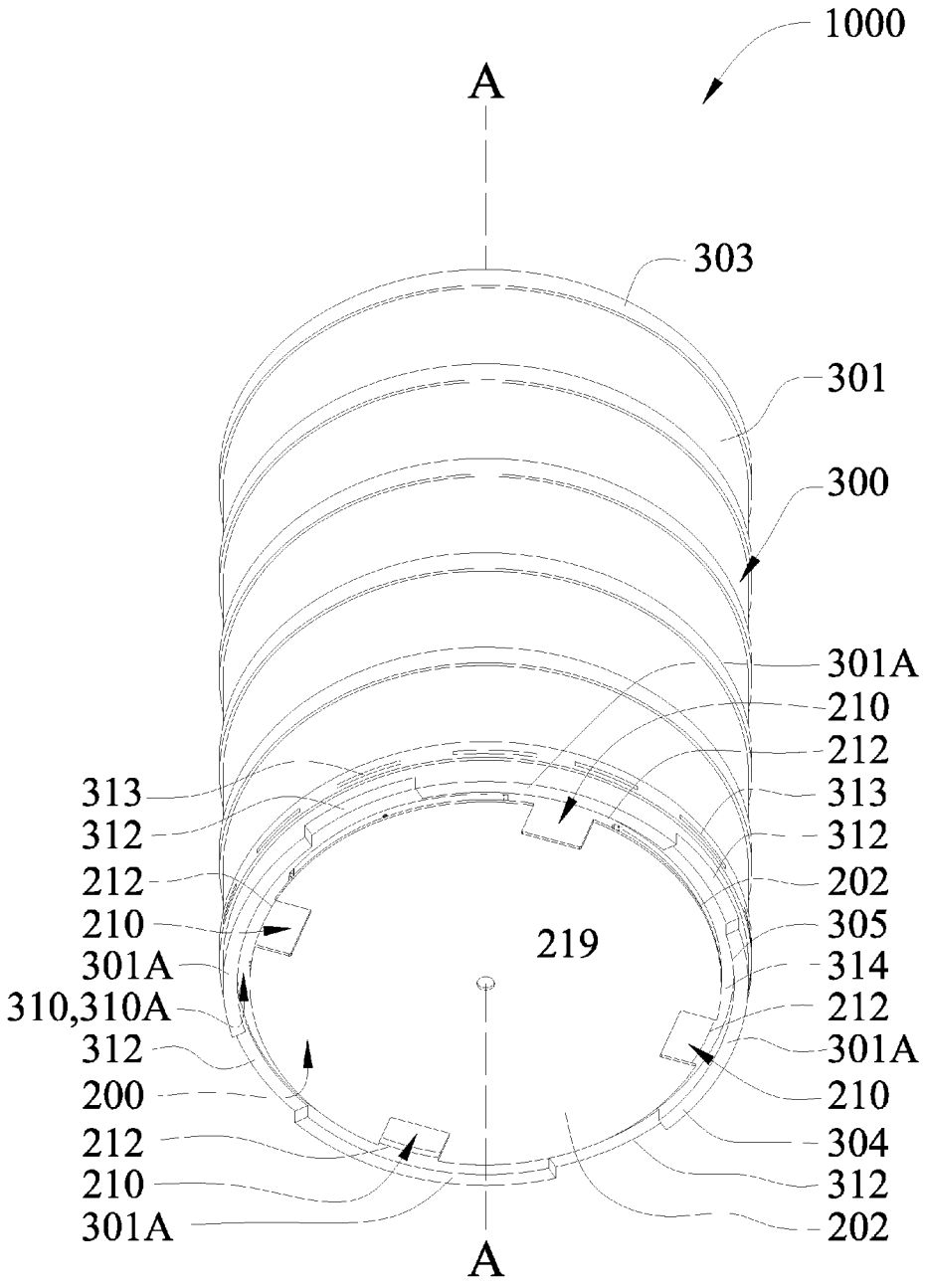
FIG. 2 is a bottom perspective view of the system of FIG. 1.
Figure 3:
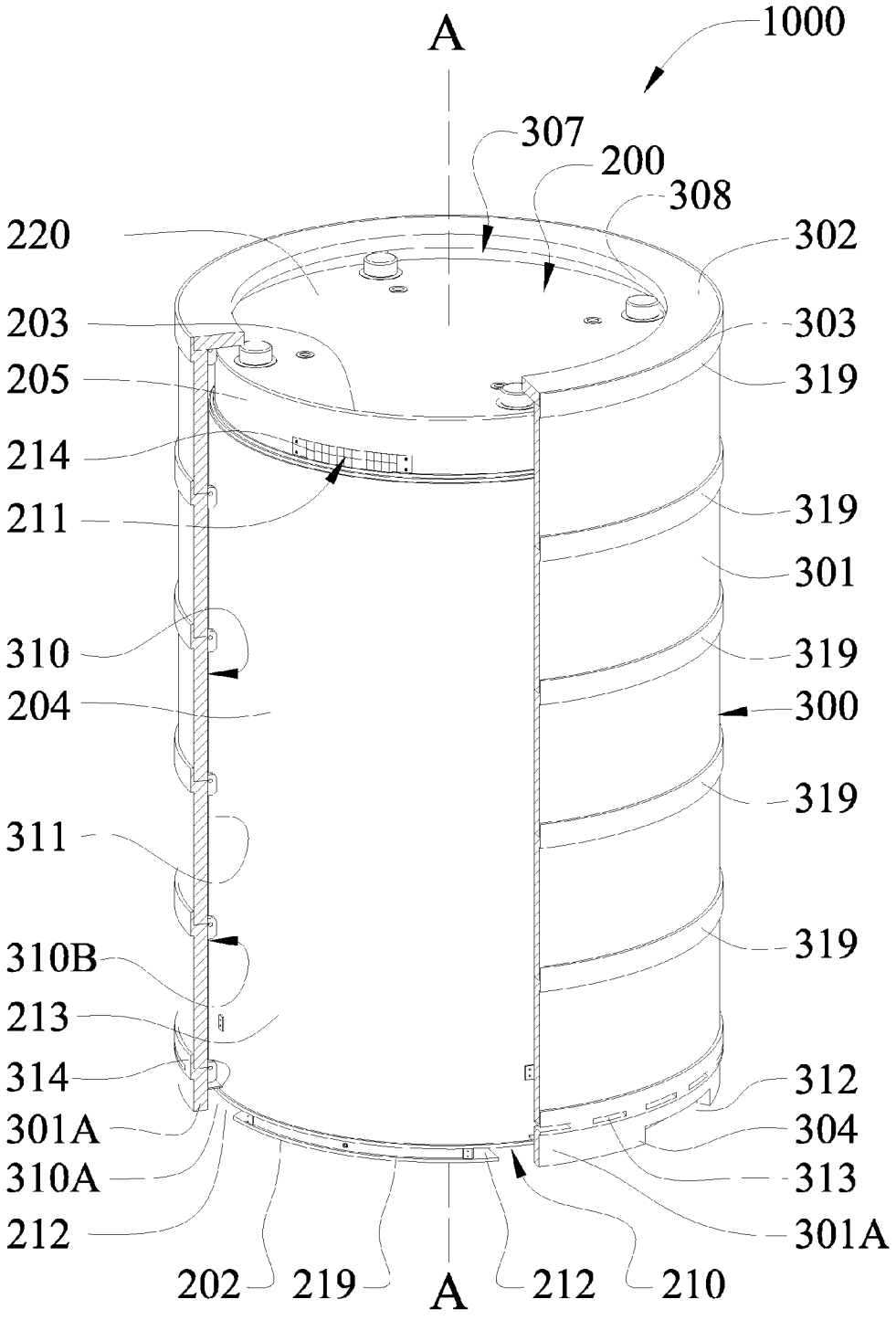
FIG. 3 is a top perspective view of the system of FIG. 1 having a section of the ancillary shield cut-away.

Referring first to FIGS. 1-3 and 7 concurrently, a system 1000 for containing high level radioactive waste according to one embodiment of the present invention is illustrated. The exemplified embodiment of the system 1000 generally comprises three major components, a canister 100 that forms a fluidic containment boundary about the high level radioactive materials, a ventilated vertical cask 200 and an ancillary shield 300. In certain embodiments, the invention may be directed solely to the shield 300. In other embodiments, the invention may be directed to the combination of the shield 300 and the ventilated vertical cask 200. In still other embodiments, the invention may be directed to the combination of the canister 100, the ventilated vertical cask 200 and the shield 300.

The canister 100 can be any type of container that forms a fluidic containment boundary about the high level radioactive materials disposed therein and can conduct heat emanating from the high level radioactive materials outwardly through the canister 100. In one embodiment, the canister 100 is engineered for the dry processing of spent nuclear fuel. Suitable canisters can include multi-purpose canisters ("MPCs") and thermally conductive casks that are hermetically sealed for the dry storage of high level wastes, such as spent nuclear fuel. Typically, such canisters comprise a honeycomb grid-workbasket, or other structure, built directly therein to accommodate a plurality of spent fuel rods in spaced relation. An example of an MPC that is particularly suitable for use in the present invention is disclosed in U.S. Pat. No. 5,898,747 to Krishna Singh, issued Apr. 27, 1999, the entirety of which is hereby incorporated by reference. Of course, the invention is not so limited in all embodiments.

When the canister 100 is loaded with high level radioactive materials, the canister 100 is housed within an internal cavity 201 of the cask 200. In the exemplified embodiment, the cask 200 is vertically oriented and extends from a bottom end 202 to a top end 203 along a longitudinal axis A-A. The cask 200 generally comprises a cylindrical body 204 and a removable lid 205. An inner surface 206 of the cylindrical body 204 forms the internal cavity 201 which has an open top end and a closed bottom end.

When the canister 100 is positioned within the cavity 201 of the cask 200, the lid 205 is secured to the top end of the cylindrical body 204 to substantially close the open top end of the internal cavity 201. The transverse cross-section of the internal cavity 201 is designed so that an annular gap 207 exists between the inner surface 206 of the cylindrical body 204 and the outer surface 101 of the canister 100. In the exemplified embodiment, the transverse cross-section of the internal cavity 201 can accommodate no more than one canister 100. However, in alternative embodiments, the internal cavity 201 may be designed to accommodate more than one canister in a side-by-side and/or stacked arrangement.

The annular gap 207 circumscribes the outer surface 101 of the canister and extends along the entire axial length of the canister 100. The annular gap 207 forms an axially extending passageway between a bottom plenum 208 formed between a bottom surface of the canister 100 and a floor of the internal cavity 201 and a top plenum 209 formed between a top surface of the canister 100 and a bottom surface of the lid 205. As discussed in greater detail below, the annular gap 207 allows cool that enters the bottom plenum 208 via the inlet ducts 210 to flow upward along the outer surface 101 of the canister 100 and into the top plenum 209 where it can exit the cask 200 via the outlet ducts 211 as warmed air.

Referring now to FIGS. 2, 3, 6 and 7 concurrently, the cask 200 further comprises a plurality of air inlet ducts 210 at the bottom end 202 of the cask 200. The plurality of inlet ducts 210 are circumferentially arranged in a spaced-apart manner about the cask 200. Each of the air inlet ducts 210 extend from an inlet opening 212 in the sidewall 213 of the cask 200 to the bottom plenum 208 of the internal cavity 201, thereby forming an air-flow passageway between a position external of the cask 200 and a bottom portion of the internal cavity 201. As can be seen, the canister 100 is supported within the cavity 201 so that a bottom surface of the canister 100 is at an axial height above a top of the inlet vents 210 to eliminate radial shine through the inlet ducts 210. In the exemplified embodiment, the cask 200 comprises a total of four inlet vents 210 arranged circumferentially about the cask 200 and spaced apart 90 degrees from each other. Of course, in other embodiments, more or less of the inlet vents 210 can be included in the cask 200 as desired.

The cask 200 further comprises a plurality of outlet ducts 211 at the top end 203 of the cask 200. The plurality of outlet ducts 211 are circumferentially arranged in a spaced-apart manner about the cask 200. Each of the air outlet ducts 210 extend from the top plenum 209 of the internal cavity 201 to an outlet opening 214 in the sidewall 213 of the cask 200, thereby forming an air-flow passageway between a position external of the cask 200 and a top portion of the internal cavity 201. In the exemplified embodiment, the outlet vents 211 are located within the lid 205 of the cask 200. However, in other embodiments, the outlet vents 211 can be located within the cylindrical body 204 of the cask 200. In the exemplified embodiment, the cask 200 comprises a total of four outlet vents 211 arranged circumferentially about the cask 200 and spaced apart 90 degrees from each other. Of course, in other embodiments, more or less of the outlet vents 211 can be included in the cask 200 as desired.

Both the lid 205 and the cylindrical body 204 of the cask 200 are constructed of material(s) that provide both gamma and neutron radiation shielding and are designed to provide the majority of the required radiation shielding (both gamma and neutron). In the exemplified embodiment, the lid 205 and the cylindrical body 204 of the cask 200 are constructed of a combination of carbon steel plates, carbon steel shells and concrete. The main structural function of the cask 200 is provided by its carbon steel components while the main radiation shielding function is provided by the annular plain concrete mass 215 and the disk plain concrete mass 216. The annular plain concrete mass 215 is enclosed by concentrically arranged cylindrical steel shells 217, 218, the thick steel baseplate 219, and the top steel annular plate 220.

The plain concrete masses 215, 216 are specified to provide the necessary shielding properties (dry density) and compressive strength for the cask 200. The principal function of the concrete masses 215, 216 is to provide shielding against gamma and neutron radiation. However, the concrete masses 215, 216 also help enhance the performance of the cask 200 in other respects as well. For example, the massive bulk of the concrete mass 215 imparts a large thermal inertia to the cask 200, allowing it to moderate the rise in temperature of the cask 200 under hypothetical conditions when all ventilation passages 210, 211 are assumed to be blocked. The case of a postulated fire accident at an ISFSI is another example where the high thermal inertia characteristics of the concrete mass 215 of the cask 200 controls the temperature of the canister 100. Although the annular concrete mass 215 is not a structural member, it does act as an elastic/plastic filler of the inter-shell space.

One example of ventilated vertical cask 200 that can be used in the system 1000 is described above. However, it is to be understood that other ventilated vertical casks can be used in conjunction with the canister 100 and/or the shield 300. For example, an additional example of a suitable cask can be found in U.S. Pat. No. 6,718,000 issued to Krishna Singh, on Apr. 6, 2004, the entirety of which is hereby incorporated by reference. Still another example of a suitable cask can be found in U.S. patent application Ser. No. 12/774,944, filed May 6, 2010, the entirety of which is hereby incorporated by reference.

Referring now to FIGS. 1-3 and 5-7 concurrently, the exemplified embodiment of the ancillary shield 300 will be described in greater detail. The shield 300 is a sleeve-like structure that is designed to slidably fit over a ventilated vertical cask, such as the cask 200, to provide additional radiation shielding and missile protection. The shield 300 is intended to be provided to circumscribe the cask 200 once it is at rest on a support surface, such as the ground. It is to be further understood that the shield 300, in and of itself, is a novel device and can constitute an embodiment of the invention independent of the cask 200 and canister 100.

Figure 7:
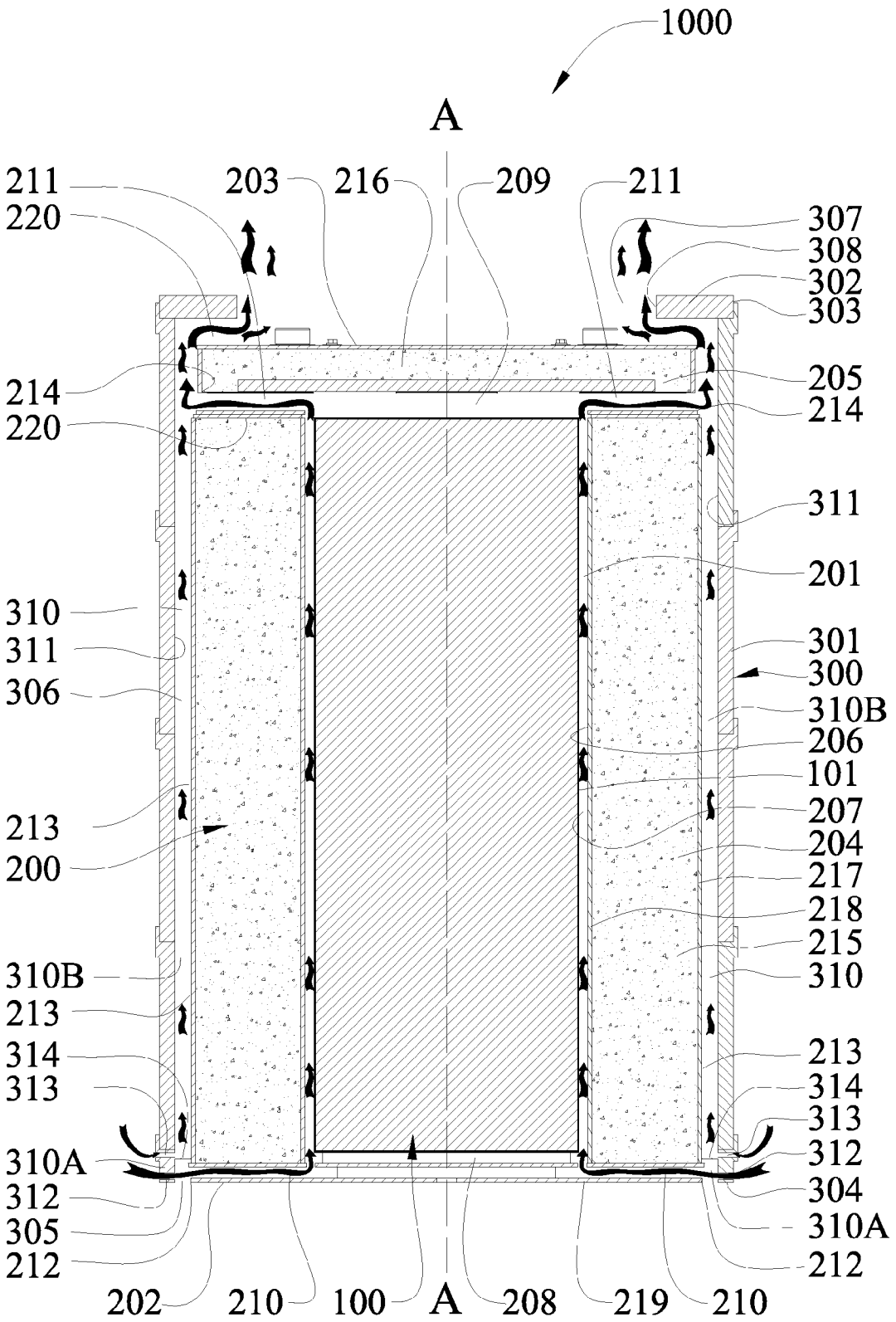
FIG. 7 is a longitudinal cross-sectional view of the system of FIG. 1 taken along the longitudinal axis A-A, wherein the natural convective cooling of the system is exemplified.

The shield 300 is a free-standing structure that circumscribes the cask 200 and provides shielding blockage over the entire height of the cask 200, as necessary depending on the specific applications. The shield 300 is effective in blocking radiation from the inlet and outlet ducts 210, 211 of the cask 200 (locations of relatively high fluence), without impeding air ventilation entering, exiting or inside the cask (FIG. 7). In order for the shield 300 to get down to very, very low dose rates, the shield 300 may be formed of material(s) so as to impart both neutron and gamma blockage capability. In certain embodiments, the shield 300 may be formed of steel, lead, concrete and/or an appropriate neutron absorber resin (such as Holtite), depending on the allowable thickness and type of radiation to be blocked (steel and concrete for both gamma and neuron, resin for neurons, and lead for gamma).

The shield 300 generally comprises a tubular shell 301 and an annular top plate 302 coupled to a top end 303 of the tubular shell 301. The shield 300 (and the tubular shell 301) extends along the longitudinal axis A-A from a bottom end 304 to a top end 303. The bottom end 304 of the shield 300 is open, comprising a bottom opening 305 through which the cask 200 can be inserted into an internal cavity 306 of the shield 300. The top end 303 of the shield 300 is also open, comprising a top opening 307, which is also the central opening of the annular ring plate 302.

The shield 300 has a vertical height that is greater than the vertical height of the cask 200. More specifically, the shield 300 has a first axial height, measured from the bottom end 304 of the shield 300 to the top end 303 of the shield 300 along a line parallel to the longitudinal axis A-A. Similarly, the cask 200 has a second axial height, measured from the bottom end 202 of the cask 200 to the top end 203 of the cask 200 along a line parallel to the longitudinal axis A-A. The first height is greater than the second height.

The annular ring plate 302 is coupled to the top end 303 of the shield 300 and extends radially inward therefrom, terminating in an inner edge 308 that defines the central opening 307. The annular ring plate 302 extends radially inward from the tubular shell 301 beyond the sidewall 213 of the cask 200. As such, the central opening 307 has a transverse area that is less than the transverse cross-sectional area of the cask 200 in the exemplified embodiment. The annular ring plate 302 is axially spaced a distance from a top surface 220 of the lid 205 of the cask 200 so that an air flow passageway exists between the central opening 307 and the annular space 310 (discussed below). The annular ring plate 302 blocks off skyshine radiation emanating at an oblique angle.

When the shield 300 is positioned, as illustrated in FIGS. 1-3 and 5-7, the tubular shell 301 circumferentially surrounds the cask 200. Because the inner diameter of the tubular shell 301 is greater than the outer diameter of the cask 200, an annular gap 310 is formed between the inner surface 311 of the tubular shell 301 and the sidewall 213 of the cask. The annular gap 310 extends along the entire axial height of the cask 301 (i.e., from the bottom end 202 of the cask 200 to the top end 203 of the cask 200). The annular gap 310 also circumscribes the cask 200.

The tubular shell 301 further comprises a plurality of the primary apertures 312 at the bottom end 304 of the shield 300. The primary apertures 312 form radial passageways through the tubular shell 301. The primary apertures 312 are circumferentially arranged in a spaced-apart manner about the tubular shell 301. The circumferential location of the primary apertures 312 is selected so that the primary apertures 312 are radially offset from the inlet openings 212 of the inlet vents 210 of the cask 200. As mentioned above, the inlet openings 212 of the inlet vents 210 present a particularly vulnerable source of radiation exposure. Thus, by radially offsetting the primary apertures 312 from the inlet openings 212 of the inlet ducts 210 of the cask 200, portions 301A of the structure of the tubular shell 301 are radially aligned with the inlet openings 212 of the inlet ducts 210 of the cask 200, thereby minimizing environmental dose.

In the exemplified embodiment, the primary apertures 312 are notches formed in the bottom edge of the tubular shell 301. However, the invention is not so limited and in other embodiments, the primary apertures 312 may be formed as prismatic openings. Furthermore, in the exemplified embodiment, the shield 300 comprises a total of four primary apertures 312 arranged circumferentially about the tubular shell 301 and spaced apart 90 degrees from each other. Of course, in other embodiments, more or less of the primary apertures 312 can be included in the shield 300 as desired.

The tubular shell 301 also comprises a plurality of the secondary apertures 313 at or near the bottom end 304 of the shield 300. The secondary apertures 313 form radial passageways through the tubular shell 301. The secondary apertures 313 are circumferentially arranged in a spaced-apart manner about the tubular shell 301. In the exemplified embodiment, the secondary apertures 313 are narrow elongated slits. However, the invention is not so limited and in other embodiments the secondary apertures 313 may take on other shapes.

In the exemplified embodiment, the secondary apertures 313 are located at first axial height from the bottom edge of the tubular shell 301 while the primary apertures 312 are located at a second height from the bottom edge of the tubular shell 301, wherein the second height is different than the first height. In the specific embodiment exemplified, the first axial height is greater than the second axial height. Of course, the invention will not be so limited in all embodiments.

The system 1000 further comprises an air flow barrier 314 extending between the tubular shell 301 and the sidewall 213 of the cask 200. The air flow barrier 314 separates the annular gap 310 into: (1) a first chamber 310A that forms a passageway between the primary apertures 312 of the tubular shell 301 and the inlet vents 310 of the cask; and (2) a second chamber 310B that forms a passageway between the secondary apertures 313 of the tubular sell 301 and the opening 307 at the top end of the shield 300. The air flow barrier 314 prohibits cross-flow of air between the first and second chambers 310A, 310B of the annular gap 310 so that two distinct cool air inlet flow pathways are formed in the system 1000. The air flow barrier 314 can prohibit cross-flow of air between the first and second chambers 310A, 310B of the annular gap 310 by itself or in conjunction with a flange on the cask and/or tubular shell.

In the exemplified embodiment, the air flow barrier 314 is coupled to and extends radially inward from the inner surface 311 of the tubular shell 301 and comes into surface contact with the sidewall 213 of the cask 200. More specifically, in the exemplified embodiment, the air flow barrier 314 is an annular plate. In such an embodiment, the first chamber 310A is a lower chamber while the second chamber 310B is an upper chamber. In this embodiment, the secondary apertures 313 are located at an axial height above the air flow barrier 314 and the primary apertures 312 are located at an axial height below the air flow barrier 314.

In order to ensure a proper seal and/or reduce interference during installation onto a cask 200, the air flow barrier 314 may be formed so as to be flexible in certain embodiments of the invention. For example, in some embodiments, the air flow barrier 314 may be formed of an elastomeric material, such as rubber or the like. In other embodiments, the flexibility of the air flow barrier 314 may be achieved by designing its thickness suitably thin so as to bend easily. Of course, the invention is not so limited and in other embodiments of the invention the air flow barrier 314 may be a rigid structure.

Figure 4:
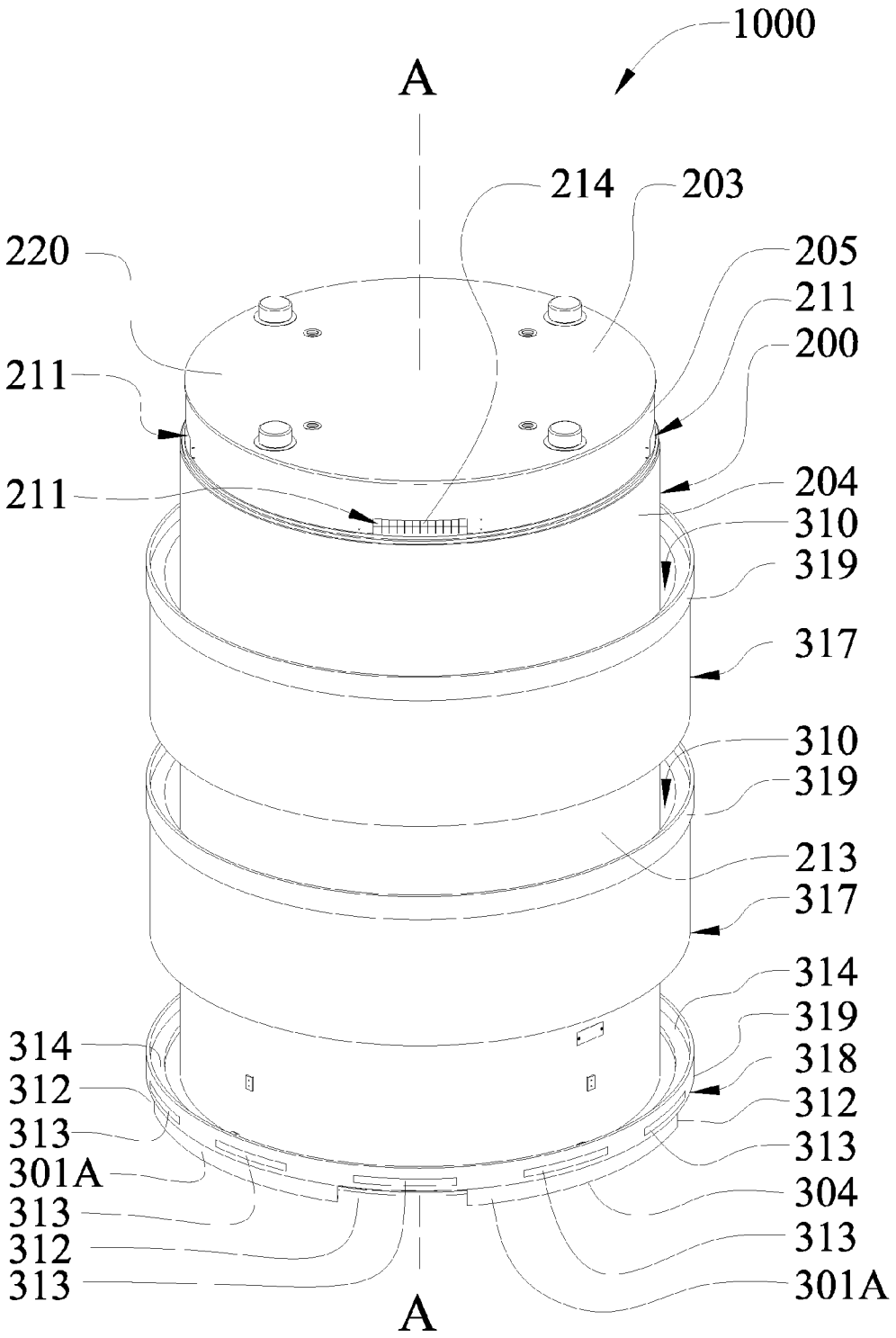
FIG. 4 is a perspective view of the system of FIG. 1 wherein shield is being assembled by stacking a plurality of tube segments.
Figure 5:
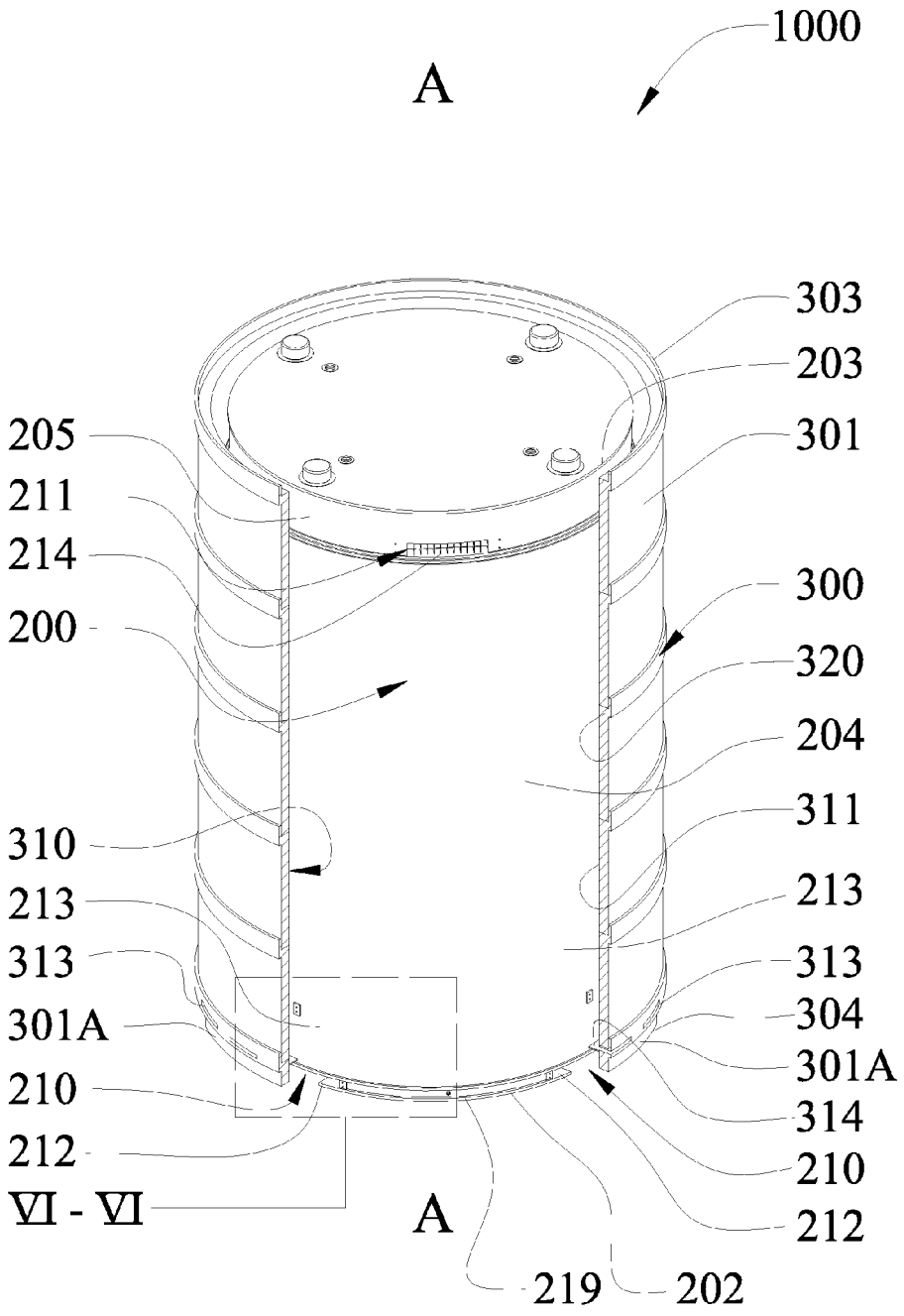
FIG. 5 is a perspective view of the system of FIG. 1 wherein all of the tube segments have been arranged in a stacked assembly that circumscribes the cask, wherein a section of tube segments are cut-away.
Figure 6:
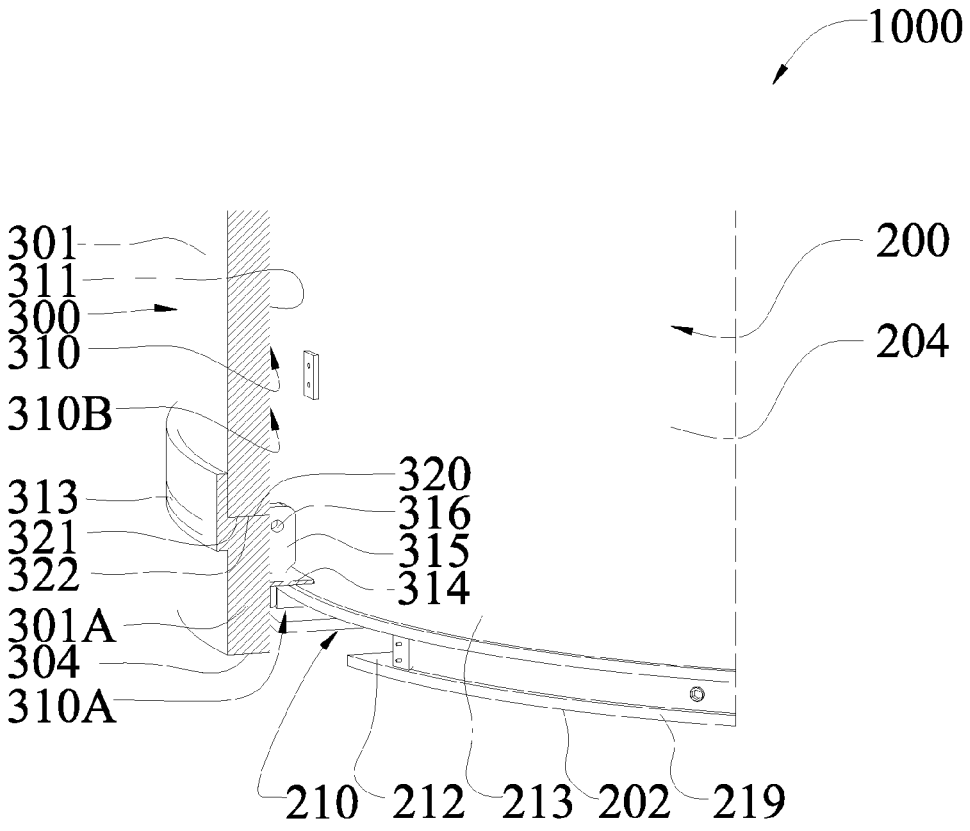
FIG. 6 is close-up view of area VI-VI of FIG. 5.

Referring now to FIGS. 4-6 concurrently, it can be seen that the tubular shell 301 of the shield 300, in the exemplified embodiment, is formed by a plurality of tube segments 317 arranged in a stacked-assembly so that a surface contact interface 320 is formed between a top edge 321 and a bottom edge 322 of adjacent tube segments 317.

When the tubular shell 301 is formed by tube segments 317, it may be preferred in certain instances to provide a collar 319 at each surface contact interface 320 that extends above and below the surface contact interfaces 320. In certain embodiments, the collars 319 may be integrally formed with the tube segments 317 and protrude from the top and/or bottom edges 321, 322. In other embodiments the collars 319 may be separate structures. The collars 319 prevent radiation escape through the surface contact interfaces 320. The collars 319 also prohibits the adjacent tube segments 317, 318 from becoming axial misaligned while allowing the adjacent tube segments 317, 318 to be separated from one another through relative movement between the adjacent tube segments 317, 318 in the axial direction. However, all tube segments 317 may be mechanically interconnected in the axial direction, if required (not shown in the figure).

In the exemplified embodiment, the primary apertures 312 and the secondary apertures 313 are located in a bottom-most tube segment 318 of the stacked assembly. Further, the air flow barrier 314 is also coupled to the bottom-most tube segment 318 of the stacked assembly in the exemplified embodiment. Of course, the invention is not so limited in all embodiments. Moreover, in certain embodiments, the tubular shell 301 could be a single unitary structure. However, by forming the shield 300 from a plurality of short tube segments 317, the shield 300 is installable without raising the cask 200 or the shield 300 to excessive heights (to protect against heavy load drop scenarios).

Further, each of the tube segments 317 comprise a plurality of spacers 315 circumferentially arranged in a spaced-apart manner about the tube segment 317 and protruding from an inner surface 311 of the tube segment 317. The spacers 315 maintain the annular gap 310 by ensuring proper relative positioning between the cask 200 and the shield 300. Each of the spacers 315 further comprise a means for facilitating engagement and lifting of the tube segment 317. In the exemplified embodiment, the lifting means is a hole 316. However, in other embodiment, the lifting mean can be a hook, a tang, a protuberance, a latch, a bracket, a clamp, a threaded surface, and/or combinations thereof. Thus, the spacers 315 can also be though of as lifting lugs.

In addition to the shield 300 serving as a radiation mitigation device, the shield 300 also largely eliminates the insulation heat flux on the cask 200, thus giving the system 1000 a heat load dividend of about 3 kilowatts. The shield 300, if properly sized, can boost the heat rejection rate from the system 1000 even more. It is recognized that the secondary openings 313 are provided to allow air to enter the upper chamber 310B of the annular gap 310. The ventilation air will help cool the external surface of the cask 200, thereby improving the heat rejection rate from the system 1000. Thus, if the annular gap 310 is properly sized then the overall heat rejection from the system 1000 will actually be enhanced. The size (width) of the annular gap 310 must be set in the narrow range that maximizes the rate of air up flow. Maximizing the air ventilation rate will allow maximum thermal-hydraulic advantage to be derived from the shield 300. The optimal gap size will depend on a number of parameters including the system heat load and cask height. Therefore it can not be set down herein a priori. However, calculations show that the optimal gap in a typical situation will lie in the range of 1 to 4 inches. The shield 300 also acts to provide a barrier against blockage of inlet vents 210 of the cask 200 by snow accumulation. Furthermore, because most of the environmental radiation dose emitted by a vertical ventilated cask, such as cask 200, comes from the casks located at the periphery, the shield 300 may be used selectively on those casks 200 where dose emission needs to be blocked to meet a specified target dose limit in the vicinity of the ISFSI (such as the §72.104 & 72.106 dose limits at the site boundary in the U.S.).

A method of containing high level radioactive materials according to one embodiment of the present invention using the system 1000 will be described. In an initial sequence, the canister 100 is transferred from a transfer cask (not illustrated) into the vertical ventilated cask 200. An example of this transfer procedure is set forth in U.S. Pat. No. 6,625,246 to Krishna Singh, issued Sep. 23, 2003, the entirety of which is hereby incorporated by reference.

Once the canister 100 is in the cask 200 and the lid 205 is secured to the cylindrical body 204, natural convective cooling (via the chimney-effect) of the canister 100 is achieved. Specifically, heat emanating form the canister 100 warms the air within the annular gap 207. The warmed air within the annular gap 207 rises as result of being warmed, thereby gathering in the top plenum 209 and exiting the cask 200 via the outlet vents 211. The outflow of the warmed air through the outlet vents 211 causes a siphon effect at the inlet openings 212 of the inlet vents 210, thereby drawing cool air that is external to the cask 200 into the bottom plenum 208 via the inlet vents 210 where the cycle is repeated.

At this stage, the cask 200 is free standing and supported on a support surface, which can be the ground or engineered surface outside or within a building. The cask 200 is vertically oriented so that the longitudinal axis A-A extends substantially vertically.

Once the cask 200 is in position, the shield 300 is installed to circumscribe the cask 200 as described below. The bottom-most tube segment 318 is first positioned above the cask 200 using a crane connected to the spacers 315. The bottom most tube segment 318 is then lowered so that the cask 200 extends through the bottom opening 305 of the shield 300. The bottom-most tube segment 318 continues to be lowered until it rests atop the support surface as illustrated in FIGS. 4 and 7. The bottom-most tube segment 318 is rotationally arranged so that the primary apertures 312 are radially offset from the inlet openings 212 of the inlet vents 210 of the cask 200. The additional tube segments 317 are then lowered in the same manner as described above for the bottom-most tube segment 318 and are stacked atop the bottom-most segment 318 (and previously positioned tube segments 317) to form a stacked assembly that extends the entire height of the cask 200, thereby forming the tubular shell 301.

Once the tubular shell 301 is complete, it circumscribed the cask 200 as described above. The annular ring plate 302 is then positioned atop the tubular shell 301 and couple thereto. If necessary the adjacent tube segments 317 and the annular ring plate 302 can be secured together via additional mechanical means if necessary to prohibit separation in the axial direction. For example, welding, fasteners, interference fits, or the like can incorporated as necessary.

At this point, the shield 300 is free standing structure supported on the support surface. The annular gap 310 between the shield 300 and the cask 200 is maintained as discussed above. When fully assembled, cool air enters the system 1000 as two separate and distinct fluid flow paths. The first flow path of cool air is siphoned into the system 1000 via the primary apertures 312. After entering the primary apertures 312, this cool air enters the first chamber 310A where it is drawn into the bottom plenum 208 of the internal cavity 201 of the cask 200 via the inlet ducts 210. This cool air then undergoes the flow discussed above for the cask 200. The second flow path of cool air is siphoned into the system 1000 via the secondary apertures 313. After entering the secondary apertures 313, this cool air enters the second chamber 310B where it is heated by heat emanating from the sidewall 213 of the cask 200. As this cool air is warmed, it rises within the second chamber 310B.

The warmed air of the first flow path that exits the outlet vents 311 of the cask converges with the warmed air of the second air flow path that rising within the second chamber 310B. The converged warm air then exist the system 1000 via the top opening 307. By converging the two air flow paths in the system 1000, the volume of outgoing warmed air flow is increased, thereby contributing a greater siphon effect at the primary and secondary apertures 312, 313.

While the invention has been described and illustrated in sufficient detail that those skilled in this art can readily make and use it, various alternatives, modifications, and improvements should become readily apparent without departing from the spirit and scope of the invention.

What is claimed is:

1. A system for containing high level radioactive materials comprising:

a cask extending along a longitudinal axis and having an internal cavity for holding high level radioactive materials, the cask comprising at least one inlet vent at a bottom end of the cask for allowing cool air to enter the internal cavity and at least one outlet vent at a top end of the cask for allowing heated air to exit the internal cavity;

a tubular shell extending from a bottom end to a top end, the tubular shell positioned to circumferentially surround the cask in a spaced apart manner so that an annular gap exists between the tubular shell and a sidewall of the cask, the tubular shell comprising at least one primary aperture forming a passageway through the tubular shell and at least one secondary aperture forming a passageway through the tubular shell; and an air flow barrier extending between the tubular shell and the sidewall of the cask that separates the annular gap into: (1) a first chamber that forms a passageway between the primary aperture and the inlet vent of the cask; and (2) a second chamber that forms a passageway between the secondary aperture and an opening at the top end of the tubular shell, wherein cross-flow of air between the first and second chambers of the annular gap is prohibited by the air flow barrier, wherein the primary aperture is configured as a first air flow inlet for the first chamber, for air to flow into the primary aperture, through the first chamber, and to the inlet vent of the cask, the primary aperture being located at an axial height below the air flow barrier, and wherein the secondary aperture is configured as a second air flow inlet for the second chamber, for air to flow into the secondary aperture, through the second chamber, and to the opening at the top end of the tubular shell, the secondary aperture being located at an axial height above the air flow barrier.

2. The system of claim 1 wherein the air flow barrier is an annular plate that separates the annular gap into an upper chamber and a lower chamber.

3. The system of claim 2 wherein the tubular shell comprises a plurality of the primary apertures circumferentially arranged in a spaced-apart manner about the tubular shell and a plurality of the secondary apertures circumferentially arranged in a spaced-apart manner about the tubular shell, wherein the secondary apertures are located at an axial height above the air flow barrier and the primary apertures are located at an axial height below the air flow barrier.

4. The system of claim 3 wherein the primary apertures are notches in a bottom edge of the tubular shell.

5. The system of claim 1 wherein the inlet vent comprises an inlet opening in the sidewall of the cask, the primary aperture of the tubular shell being radially offset from the inlet opening of the inlet vent.

6. The system of claim 1 further comprising:

the tubular shell comprising a plurality of the primary apertures circumferentially arranged in a spaced-apart manner about the tubular shell;

the cask comprising a plurality of inlet vents, each of the inlet vents comprising an inlet opening in the sidewall of the cask, the inlet openings of the inlet vents circumferentially arranged in a spaced-apart manner about the bottom end of the cask; and wherein the inlet openings of the inlet vents are radially offset from the primary apertures of the tubular shell.

7. The system of claim 6 wherein the inlet openings are notches formed in a bottom edge of the tubular shell.

8. The system of claim 6 wherein the tubular shell comprises a plurality of the secondary apertures circumferentially arranged in a spaced-apart manner about the tubular shell.

9. The system of claim 1 wherein the outlet vent terminates in an outlet opening in the sidewall of the cask in the second chamber of the annular gap.

10. The system of claim 1 wherein the tubular shell comprises a plurality of tube segments arranged in a stacked-assembly so that a surface contact interface is formed between a top edge and a bottom edge of adjacent tube segments, the system further comprising a collar located at each surface contact interfaces and extending above and below the surface contact interface.

11. The system of claim 10 wherein the primary aperture and the secondary aperture are located in a bottom-most tube segment of the stacked assembly.

12. The system of claim 11 wherein the air flow barrier is coupled to the bottom-most tube segment of the stacked assembly.

13. The system of claim 10 wherein the collar prohibits the adjacent tube segments from becoming axial misaligned while allowing the adjacent tube segments to be separated from one another through relative movement between the adjacent tube segments in the axial direction.

14. The system of claim 10 wherein each of the tube segments comprise a plurality of spacers circumferentially arranged in a spaced-apart manner about the tube segment and protruding from an inner surface of the tube segment to maintain the annular gap.

15. The system of claim 14 wherein each of the spacers comprise a means for facilitating engagement and lifting of the tube segment.

16. The system of claim 1 wherein the annular gap circumscribes the cask.

17. The system of claim 1 further comprising an annular top ring defining a central opening and coupled to a top end of the tubular shell, the annular top ring extending radially inward from the tubular end wall beyond the sidewall of the cask and spaced from a top surface of a lid of the cask, the central opening of the annular top ring being the opening at the top end of the tubular shell.

18. The system of claim 1 wherein the tubular shell has a height measured from the top end of the tubular shell to the bottom end of the tubular shell, the cask having a height measured from the top end of the cask to the bottom end of the cask, the height of the tubular shell being greater than the height of the cask.

19. The system of claim 18 wherein the tubular shell is a free-standing structure.

20. The system of claim 1 wherein the tubular shell is slidably removable from the cask by imparting axial movement to the tubular shell.

21. The system of claim 1 wherein the air flow barrier is coupled to the tubular shell and is flexible.

22. A system for containing high level radioactive materials comprising:

a cask extending along a longitudinal axis and having an internal cavity for holding high level radioactive materials, the cask comprising a plurality of inlet vents at a bottom end of the cask for allowing cool air to enter the internal cavity and a plurality of outlet vents at a top end of the cask for allowing heated air to exit the internal cavity;

a tubular shell extending from a bottom end to a top end, the tubular shell positioned to circumferentially surround the cask in a spaced apart manner so that an annular gap exists between the tubular shell and a sidewall of the cask, the tubular shell comprising a plurality of primary apertures forming passageways through the tubular shell and a plurality of secondary apertures forming passageways through the tubular shell; and a flexible annular seal coupled to the tubular shell that separates the annular gap into: (1) an upper chamber that forms a passageway between the primary aperture and the inlet vent of the cask; and (2) a second chamber that forms a passageway between the secondary aperture and an opening at the top end of the tubular shell, wherein cross-flow of air between the first and second chambers of the annular gap is prohibited by the flexible annular seal, wherein the primary apertures are each configured as a first air flow inlet for the first chamber, for air to flow into the primary aperture, through the first chamber, and to the inlet vent of the cask, the primary aperture being located at an axial height below the flexible annular seal, and wherein the secondary apertures are each configured as a second air flow inlet for the second chamber, for air to flow into the secondary aperture, through the second chamber, and to the opening at the top end of the tubular shell, the secondary aperture being located at an axial height above the flexible annular seal.

23. The system of claim 22 wherein the primary apertures are circumferentially arranged in a spaced-apart manner about the tubular shell and the secondary apertures are circumferentially arranged in a spaced-apart manner about the tubular shell.

24. The system of claim 23 wherein each of the inlet vents comprise an inlet opening in the sidewall of the cask, the primary apertures of the tubular shell being radially offset from the inlet openings of the inlet vents.

25. The system of claim 24 wherein each of the outlet vents terminate in an outlet opening in the sidewall of the cask in the upper chamber of the annular gap, wherein the primary apertures and the inlet opening are located at a first axial height, the secondary apertures are located at a second axial height, and the outlet openings are located at a third axial height, and wherein the first, second and third axial heights are different.

26. The system of claim 22 wherein the tubular shell comprises a plurality of tube segments arranged in a stacked-assembly so that a surface contact interface is formed between a top edge and a bottom edge of adjacent tube segments, the system further comprising a collar located at each surface contact interfaces and extending above and below the surface contact interface.

27. The system of claim 26 wherein each of the tube segments comprise a plurality of spacers circumferentially arranged in a spaced-apart manner about the tube segment and protruding from an inner surface of the tube segment to maintain the annular gap.

28. The system of claim 27 wherein each of the spacers comprise a means for facilitating engagement and lifting of the tube segment.

29. The system of claim 22 further comprising an annular top ring defining a central opening and coupled to a top end of the tubular shell, the annular top ring extending radially inward from the tubular end wall beyond the sidewall of the cask and spaced from a top surface of a lid of the cask, the central opening of the annular top ring being the opening at the top end of the tubular shell.

30. The system of claim 22 wherein the tubular shell has a height measured from the top end of the tubular shell to the bottom end of the tubular shell, the cask having a height measured from the top end of the cask to the bottom end of the cask, the height of the tubular shell being greater than the height of the cask.

31. The system of claim 22 wherein the tubular shell is a free-standing structure that is slidably removable from the cask by imparting axial movement to the tubular shell.

32. An apparatus for providing additional radiation shielding to a cask holding high level radioactive materials comprising:

a tubular shell extending from an open bottom end to an open top end, the tubular shell having an inner surface that forms a cavity about a longitudinal axis;

a plurality of primary apertures forming passageways through the tubular shell and circumferentially arranged in a spaced-apart manner about the tubular shell, each primary aperture being configured as a first air flow inlet;

a plurality of secondary apertures forming passageways through the tubular shell and circumferentially arranged in a spaced-apart manner about the tubular shell, each of the secondary apertures being configured as a second air flow inlet;

an annular seal coupled to the tubular shell and extending from the inner surface of the tubular shell; and wherein the secondary apertures are located at an axial height above the annular seal and the primary apertures are located at an axial height below the annular seal.

33. The apparatus of claim 32 wherein the annular seal is flexible.

34. The apparatus of claim 32 wherein the tubular shell comprises a plurality of tube segments arranged in a stacked-assembly so that a surface contact interface is formed between a top edge and a bottom edge of adjacent tube segments, the system further comprising a collar located at each surface contact interfaces and extending above and below the surface contact interface.

35. The apparatus of claim 34 wherein the primary aperture, the secondary aperture and the annular seal are located in a bottom-most tube segment of the stacked assembly.

36. The system of claim 34 wherein the collar prohibits the adjacent tube segments from becoming axial misaligned.

37. The system of claim 34 wherein each of the tube segments comprise a plurality of spacers circumferentially arranged in a spaced-apart manner about the tube segment and protruding from an inner surface of the tube segment to maintain the annular gap.

38. The system of claim 37 wherein each of the spacers comprise a means for facilitating engagement and lifting of the tube segment.

39. The system of claim 32 further comprising an annular top ring defining a central opening and coupled to a top end of the tubular shell, the annular top ring extending radially inward from the tubular end wall.

40. A method of containing high level radioactive materials comprising:

a) positioning a cask on a support surface, the cask extending along a vertical axis and having an internal cavity containing high level radioactive materials, the cask comprising at least one inlet vent at a bottom end of the cask allowing cool air to enter the internal cavity and at least one outlet vent at a top end of the cask allowing heated air to exit the internal cavity; and b) sliding a tubular shell over the cask, the tubular shell circumferentially surrounding the cask in a spaced apart manner so that an annular gap exists between the tubular shell and a sidewall of the cask, the tubular shell comprising at least one primary aperture forming a passageway through the tubular shell, at least one secondary aperture forming a passageway through the tubular shell, and an air flow barrier extending between the tubular shell and the sidewall of the cask that separates the annular gap into: (1) a first chamber that forms a passageway between the primary aperture and the inlet vent of the cask; and (2) a second chamber that forms a passageway between the secondary aperture and an opening at the top end of the tubular shell, wherein cross-flow of air between the first and second chambers of the annular gap is prohibited by the air flow barrier, wherein the at least one primary aperture performs as a first air flow inlet for the first chamber, for air to flow into the primary aperture, through the first chamber, and to the inlet vent of the cask, and wherein the at least one secondary aperture performs as a second air flow inlet for the second chamber, for air to flow into the secondary aperture, through the second chamber.

41. The method of claim 40 further comprising:

c) cool air entering the first chamber via the primary aperture of the tubular shell, the cool air within the first chamber being drawn into the internal cavity of the cask via an inlet duct, the cool air within the internal cavity becoming warmed within the internal cavity from heat emanating from the high level radioactive materials and exiting the internal cavity of the cask via an outlet duct as warmed air; and e) cool air entering the second chamber via the secondary aperture, the cool air within the second chamber being warmed by heat emanating from the cask and rising within the second chamber as warmed air; and wherein the warmed air exiting the outlet duct and the warmed air rising within the second chamber converge and exit the tubular shell via the opening at the top end of the tubular shell.

42. The method of claim 40 wherein step b) comprises sliding a plurality of tube segments over the cask and stacking the tube segments to form a stacked assembly that forms the tubular shell.

* * * * *